US010953973B2

(12) United States Patent
Hayashi et al.

(10) Patent No.: US 10,953,973 B2
(45) Date of Patent: Mar. 23, 2021

(54) SHIP HANDLING DEVICE AND SHIP INCLUDING THE SAME

(71) Applicant: Yanmar Co., Ltd., Osaka (JP)

(72) Inventors: Akiyoshi Hayashi, Osaka (JP); Koichi Kanda, Osaka (JP); Jun Watanabe, Osaka (JP)

(73) Assignee: YANMAR POWER TECHNOLOGY CO., LTD., Osaka (JP)

( * ) Notice: Subject to any disclaimer, the term of this patent is extended or adjusted under 35 U.S.C. 154(b) by 191 days.

(21) Appl. No.: 16/070,904

(22) PCT Filed: Jul. 21, 2016

(86) PCT No.: PCT/JP2016/071339
§ 371 (c)(1),
(2) Date: Jul. 18, 2018

(87) PCT Pub. No.: WO2017/126144
PCT Pub. Date: Jul. 27, 2017

(65) Prior Publication Data

US 2019/0061900 A1 Feb. 28, 2019

(30) Foreign Application Priority Data

Jan. 18, 2016 (JP) ..... JP2016-007491

(51) Int. Cl.
*B63H 25/02* (2006.01)
*B63H 25/42* (2006.01)

(52) U.S. Cl.
CPC ..... *B63H 25/02* (2013.01); *B63H 25/42* (2013.01); *B63H 2025/026* (2013.01); *B63H 2025/425* (2013.01)

(58) Field of Classification Search
CPC .. B63H 25/02; B63H 25/42; B63H 2025/425; B63H 2025/026
(Continued)

(56) References Cited

U.S. PATENT DOCUMENTS 5,595,133 A * 1/1997 Bullard ..... B63C 11/49 114/66
9,440,724 B2 * 9/2016 Suzuki ..... G05D 1/0206
(Continued)

FOREIGN PATENT DOCUMENTS

EP 3210880 A1 8/2017
GB 2374847 A * 10/2002 ..... B63H 21/22
(Continued)

OTHER PUBLICATIONS

Supplementary European Search Report dated Oct. 19, 2018 to the corresponding European Patent Application No. 16886384.
(Continued)

*Primary Examiner* — Victor L MacArthur
(74) *Attorney, Agent, or Firm* — Norton Rose Fulbright US LLP

(57) ABSTRACT

A ship handling device including a joystick lever configured to be inclined in a desired direction at a desired angle, and a ship handling control device configured to control driving of a forward-backward propeller generating a thrust in a front-and-rear direction of a ship body and a thruster generating a thrust in a left-and-right direction of the ship body. The ship handling control device has a normal mode in which driving of the forward-backward propeller and the thruster is controlled according to an input signal from the joystick lever, and a thruster single-driven mode in which driving of only the thruster is controlled according to an input signal from the joystick lever, and the ship handling control device is connected to a mode changing switch with which a switchover between the normal mode and the thruster single-driven mode is performed.

4 Claims, 7 Drawing Sheets

(58) Field of Classification Search
USPC ..... 701/41; 440/40–43; 114/144 R, 150, 114/151
See application file for complete search history.

(56) References Cited

U.S. PATENT DOCUMENTS

| | | | | |
|---|---|---|---|---|
| 2010/0138083 | A1 | 6/2010 | Kaji | |
| 2011/0172858 | A1* | 7/2011 | Gustin | B63H 21/213 701/21 |
| 2014/0352595 | A1* | 12/2014 | Yuet | G05D 1/0016 114/150 |
| 2016/0096611 | A1* | 4/2016 | Suzuki | B63H 25/42 701/2 |

FOREIGN PATENT DOCUMENTS

| | | | |
|---|---|---|---|
| JP | 06-270891 | A | 9/1994 |
| JP | 2000-001199 | A | 1/2000 |
| JP | 2010-126085 | A | 6/2010 |
| JP | 4809794 | B2 | 8/2011 |

OTHER PUBLICATIONS

International Search Report dated Sep. 27, 2016 issued in corresponding PCT Application PCT/JP2016/071339.

* cited by examiner

SHIP HANDLING DEVICE AND SHIP INCLUDING THE SAME

CROSS REFERENCES TO RELATED APPLICATIONS

This application is a national stage application pursuant to 35 U.S.C. § 371 of International Application No. PCT/JP2016/071339, filed on Jul. 21, 2016, which claims priority under 35 U.S.C. § 119 to Japanese Patent Application No. 2016-007491, filed on Jan. 18, 2016, the disclosures of which are hereby incorporated by reference in their entireties.

TECHNICAL FIELD

The present invention relates to a ship handling device and a ship including the ship handling device.

BACKGROUND ART

Heretofore, a ship has been disclosed that includes: a bow thruster for generating a thrust in a left-and-right direction of the ship; a propeller for generating a thrust in a front-and-rear direction of the ship; and a joystick lever freely turnable along three axes of an x-axis, a y-axis, and a z-axis, wherein driving of the bow thruster and the propeller is controlled based on a turning angle of the joystick lever along the x-axis and/or the y-axis to cause the ship to move in the front-and-rear direction, a lateral direction, or an oblique direction, and driving of the bow thruster and the propeller is controlled based on a turning angle of the joystick lever along the z-axis to cause the ship to make a turn (see Patent Literature 1 (hereinafter, referred to as PTL 1)).

In addition, the ship includes a motor for driving the bow thruster, and the motor is connected to a bow-thruster remote controller. The bow-thruster remote controller includes left and right buttons. When the left or right button on the bow-thruster remote controller is pressed, a certain thrust is generated toward the left or the right of the ship.

CITATION LIST

Patent Literature

Japanese Patent No. 4809794

SUMMARY OF INVENTION

Technical Problem

In the ship having the above configuration, if an operator wishes to perform drive control with the thruster (bow thruster) and the propeller, the operator uses the joystick lever. Meanwhile, if the operator wishes to perform drive control with the thruster alone, the operator needs to use the controller (bow-thruster remote controller). Consequently, it is troublesome to handle the ship in some cases.

In order to deal with this, some aspects of the present invention have an object to provide: a ship handling device with which a thruster can be driven alone without a controller additionally provided; and a ship including the ship handling device.

Solution to Problem

A ship handling device according to an aspect of the present invention includes: a joystick lever configured to be inclined in a desired direction at a desired angle; and a ship handling control device configured to control driving of a forward-backward propeller that generates a thrust in a front-and-rear direction of a ship body and a thruster that generates a thrust in a left-and-right direction of the ship body, wherein the ship handling control device has a normal mode in which driving of the forward-backward propeller and the thruster is controlled according to an input signal from the joystick lever and a thruster single-driven mode in which driving of only the thruster is controlled according to an input signal from the joystick lever, the ship handling control device is connected to a mode changing switch with which a switchover between the normal mode and the thruster single-driven mode is performed, and in the thruster single-driven mode, the thruster handling control device does not drive the thruster in a case where the joystick lever is inclined in a direction that is not a thruster driven direction.

The ship handling device according to the aspect of the present invention is preferably configured such that, in the thruster single-driven mode, the ship handling control device adjusts a thrust of the thruster based on an operation amount of the joystick lever.

A ship according to an aspect of the present invention includes the ship handling device.

Advantageous Effects of Invention

With the ship handling device according to the aspect of the present invention and the ship including the ship handling device, it is possible to drive the thruster alone with use of the joystick lever, which is used in a handling operation of the ship. Consequently, it is possible to save the space and to improve controllability of the ship.

DESCRIPTION OF EMBODIMENTS

Figure 1:
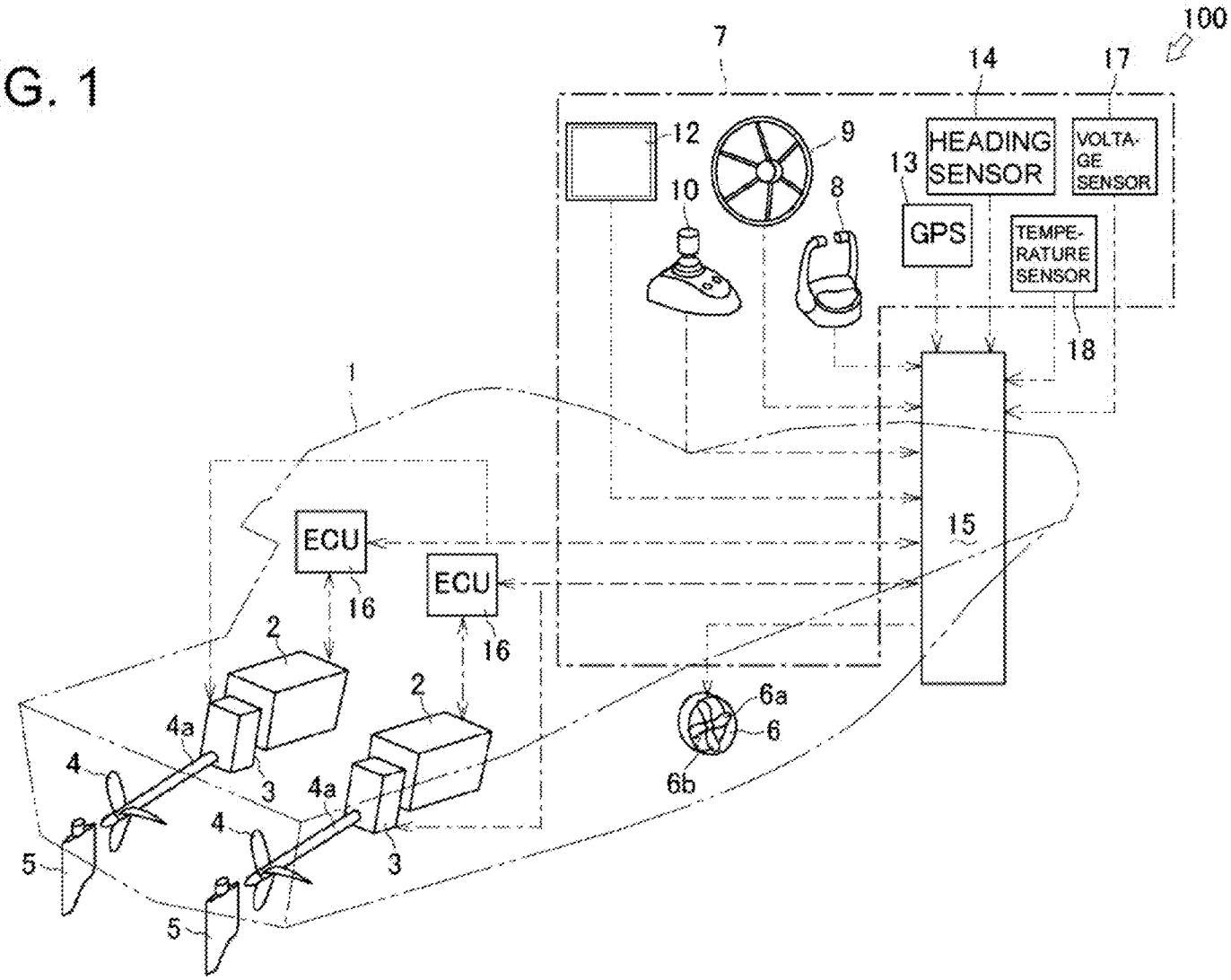
FIG. 1 is a view schematically illustrating an overview of an entire ship including a ship handling device.

First, with reference to FIG. 1 to FIG. 3B, an overview and a configuration of an entire ship 100 including a ship handling device 7 will be described. The ship 100 illustrated in FIG. 1 is a so-called twin-screw ship (shaft ship). However, the number of propeller shafts and the type of the propulsion device are not limited to those in the twin-screw ship. Alternatively, the ship 100 may be a ship provided with a plurality of shafts or an outdrive-type ship. In the present embodiment, a front-and-back direction and a left-and-right direction are defined with a bow direction of the ship 100 being defined as the front.

Figure 2:
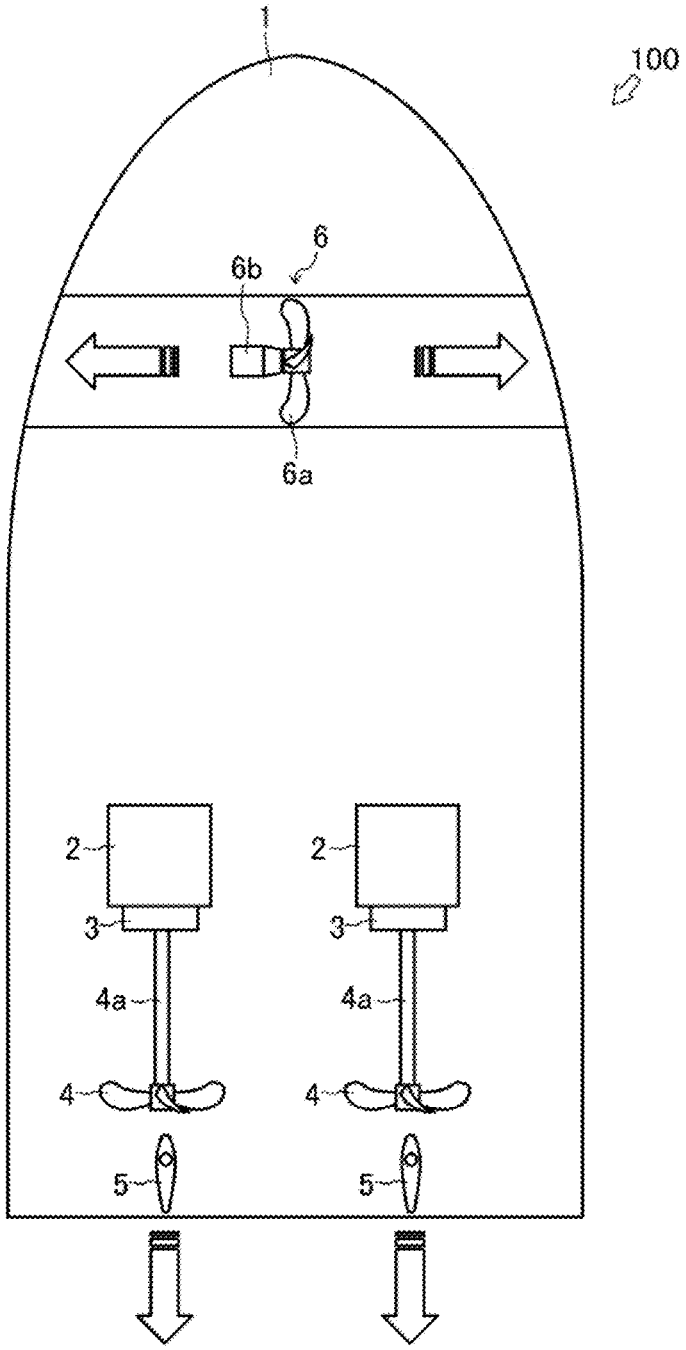
FIG. 2 is a plan view schematically illustrating arrangement of a thruster and forward-backward propellers in the ship including the ship handling device.

As illustrated in FIGS. 1 and 2, the ship 100 is a shaft ship in which driving power from engines 2, which are a driving power source, is transmitted to forward-backward propellers 4 through propeller shafts 4*a*. The ship 100 has a ship body 1 provided with propulsion devices and the ship handling device 7. The propulsion devices include the engines 2, switching clutches 3, the forward-backward propellers 4, rudders 5, a thruster 6, and ECUs 16. The ship handling device 7 includes an accelerator lever 8, a steering wheel 9, a joystick lever 10, a monitor 12, a global positioning system (GPS) device 13, a heading sensor (orientation sensor) 14, a voltage sensor 17, a temperature sensor 18, and a ship handling control device 15. In the present embodiment, the ship 100 is the shaft ship including two propulsion devices respectively disposed on a port side and a starboard side of the ship 100. However, the ship 100 is not limited to this. Alternatively, the ship 100 may be a stern drive ship or the like.

The two engines 2 each generate driving power for rotating a corresponding one of the forward-backward propellers 4 on the port side and the starboard side. One of the engines 2 is disposed in a rear portion of the port side of the ship body 1, and the other of the engines 2 is disposed in a rear portion of the starboard side of the ship body 1. The engines 2 each have an output shaft to which a corresponding one of the switching clutches 3 is connected.

The two switching clutches 3 switch the driving power, transmitted from the output shafts of the engines 2, between a forward rotation direction and a reverse rotation direction, and output the resulting driving power. The switching clutches 3 each have an input side connected to a corresponding one of the output shafts 2 of the engines 2. The switching clutches 3 each have an output side connected to a corresponding one of the propeller shafts 4*a*. Thus, the switching clutches 3 are each configured to transmit the driving power from a corresponding one of the engines 2 to a corresponding one of the propeller shafts 4*a*.

The two forward-backward propellers 4 each generate a thrust in the front-and-rear direction of the ship body 1. The forward-backward propellers 4 are respectively connected to the two propeller shafts 4*a* extending to the outside of the ship through a port-side portion and a starboard-side portion of the bottom of the ship body 1. The forward-backward propellers 4 are rotated by the driving power transmitted thereto from the engines 2 via the propeller shafts 4*a*. Multiple blades arranged around a rotating shaft of each of the propeller shafts 4*a* rotate in water in the periphery, so that a thrust is generated.

The two rudders 5 change the direction of a water flow generated by the rotation of the forward-backward propellers 4. One of the rudders 5 is disposed at a rear end (stern side) of the port-side portion of the bottom of the ship 1 and in rear of a corresponding one of the forward-backward propellers 4. The other of the rudders 5 is disposed at a rear end (stern side) of the starboard-side portion of the bottom of the ship body 1 and in rear of a corresponding one of the forward-backward propellers 4. The rudders 5 are each capable of turning about its corresponding rotating shaft provided in the ship body 1, in a left-and-right direction within a predetermined angle range. The rudders 5 are interlockingly connected to the steering wheel 9. Thus, the rudders 5 are configured such that, when the steering wheel 9 is operated to cause rear ends of the rudders 5 to be directed to the right of the ship body 1, a thrust generated by the resulting water flow presses the stern of the ship 100 to the left, so that the bow of the ship 100 is directed to the right. Similarly, the rudders 5 are configured such that, when the steering wheel 9 is operated to cause the rear ends of the rudders 5 to be directed to the left of the ship 100, a thrust generated by the resulting water flow presses the stern of the ship 100 to the right, so that the bow of the ship 100 is directed to the left.

The thruster 6 generates a thrust in the left-and-right direction of the ship body 1. The thruster 6 is disposed in a location closer to the bow of the ship body 1 and in the center in the left-and-right direction. The thruster 6 includes a propeller 6*a* and a motor 6*b*. The motor 6*b* is connected to the joystick lever 10, and is rotatable at a desired rotation speed. The thruster 6 is configured to allow the propeller 6*a* to generate a thrust in the left-and-right direction of the ship body 1. The thruster 6 drives the motor 6*b* according to a signal from the joystick lever 10 to rotate the propeller 6*a* to generate a thrust having a desired magnitude and acting in the left-and-right direction. The motor 6*b* may be configured to be rotatable at a desired rotation speed.

The accelerator lever 8 included in the ship handling device 7 generates a signal for a rotation speed of the forward-backward propeller 4 on the port side, a signal for a rotation speed of the forward-backward propeller 4 on the starboard side, and signals for rotation directions of these forward-backward propellers 4. The accelerator lever 8 includes a lever for the forward-backward propeller 4 on the port side and a lever for the forward-backward propeller 4 on the starboard side. That is, the accelerator lever 8 is configured to independently generate a signal for the forward-backward propeller 4 on the port side and a signal for the forward-backward propeller 4 on the starboard side. The accelerator lever 8 is configured to be inclined at a desired angle in the front-and-rear direction of the ship 100. The accelerator lever 8 is configured to independently generate signals for rotation speeds of the engines 2 and signals for switching states of the switching clutches 3 corresponding to the engines 2, based on the operation direction and the operation amount. When the accelerator lever 8 is operated so that the accelerator lever 8 is inclined forward, the accelerator lever 8 generates signals for the forward-backward propellers 4 to generate a thrust for moving the ship 100 forward. Meanwhile, when the accelerator lever 8 is operated so that the accelerator lever 8 is inclined rearward, the accelerator lever 8 generates signals for the forward-backward propellers 4 to generate a thrust for moving the ship 100 backward.

The steering wheel 9 included in the ship handling device 7 is used to change turning angles of the rudders 5. The steering wheel 9 is interlockingly connected to the rudders 5 on the port side and on the starboard side via a wire link mechanism or a hydraulic circuit. When the steering wheel 9 is turned to the right, the rear ends of the rudders 5 are turned to be directed to the right. Consequently, a water flow generated by the forward-backward propellers 4 is directed to the right, so that the stern of the ship 100 is pressed to the left and accordingly the bow of the ship 100 is directed to the right. Similarly, when the steering wheel 9 is turned to the left, the rear ends of the rudders 5 are turned to be directed to the left. Consequently, a water flow generated by the forward-backward propellers 4 is directed to the left, so that the stern of the ship 100 is pressed to the right and accordingly the bow of the ship 100 is directed to the left.

Figure 3A:
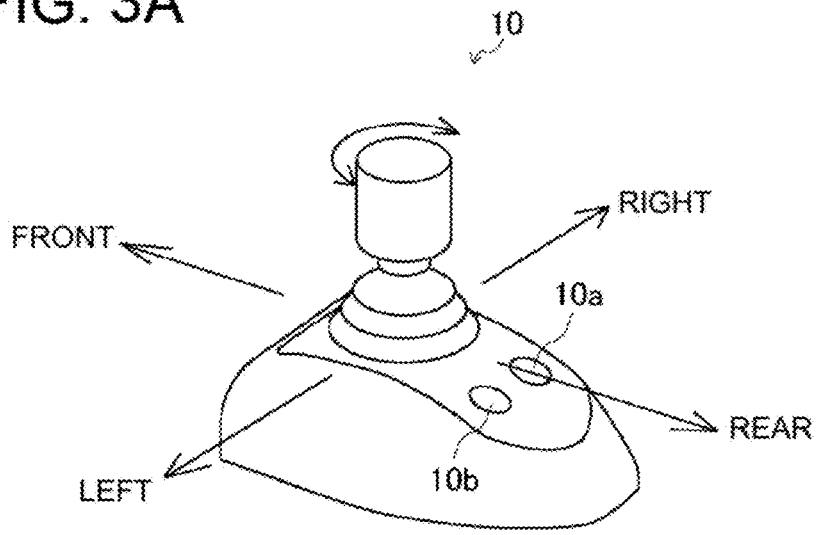
FIG. 3A is a perspective view illustrating a configuration of a joystick lever of the ship handling device.
Figure 3B:
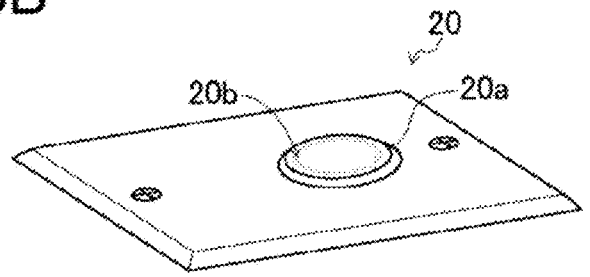
FIG. 3B is a perspective view illustrating a mode changing switch.

As illustrated in FIG. 1 and FIG. 3A, the joystick lever 10 included in the ship handling device 7 generates a signal for causing the ship 100 to move in a desired direction or a signal for driving the thruster 6 alone. The joystick lever 10 can be inclined in a desired direction at a desired angle. The joystick lever 10 can be operated to turn about a lever axis at a desired angle. The joystick lever 10 is configured to generate, based on the operation mode and the operation amount, signals for rotation speeds of the engines 2 and switching states of the switching clutches 3 and signals for a rotation speed and a rotation direction of the thruster 6 or only signals for a rotation speed and a rotation direction of the thruster 6.

The joystick lever 10 is provided with a switch 10*a* and a change switch 10*b*. The switch 10*a* is used to perform various settings, such as changing an operation sensitivity of the joystick lever 10 by changing, e.g., engine speeds of the engines 2 in response to a predetermined operation amount and an initial setting (calibration) for lateral movement, oblique movement, and turning of the ship 100. The change switch 10*b* is used to enable or disable an operation of the joystick lever 10. In addition, the joystick lever 10 may be provided with a dynamic positioning control switch for giving an instruction to start dynamic positioning control.

The GPS device 13 included in the ship handling device 7 measures (calculates) positional coordinates of the ship 100. The GPS device 13 receives signals from a plurality of GPS satellites, calculates positional coordinates of the ship 100, and outputs a latitude La (n) and a longitude Lo (n) representing the current position. That is, the GPS device 13 calculates absolute values of the positional coordinates of the ship 100.

The heading sensor 14 that is an orientation sensor included in the ship handling device 7 measures (calculates) a direction of the ship 100. The heading sensor 14 calculates an orientation of the bow of the ship 100 from the Earth's magnetic field. That is, the heading sensor 14 calculates an absolute orientation of the bow of the ship 100. The heading sensor 14 may be a satellite compass (Registered Trademark) that calculates the orientation with use of the GPS device 13.

The voltage sensor 17 included in the ship handling device 7 is used to detect a voltage for driving the motor 6*b* in the thruster 6.

The temperature sensor 18 included in the ship handling device 7 is used to detect a temperature of the motor 6*b* in the thruster 6.

As illustrated in FIG. 1, each of the ECUs 16 controls a corresponding one of the engines 2. In each of the ECUs 16, various programs and data for controlling a corresponding one of the engines 2 are stored. The ECUs 16 are provided for their respective engines 2. Each of the ECUs 16 may have a configuration in which a CPU, a ROM, a RAM, an HDD and/or the like are connected to each other via a bus, or may have a configuration including a single-chip LSI and/or the like.

Each of the ECUs 16 is connected to components of a corresponding one of the engines 2, such as a fuel adjustment valve of a fuel supply pump, a fuel injection valve, and various sensors (these components are not illustrated). The ECU 16 is capable of controlling an amount supplied from the fuel adjustment valve and opening/closing of the fuel injection valve, and is also capable of obtaining information detected by various sensors.

The ship handling control device 15 included in the ship handling device 7 controls the engines 2, the switching clutches 3, and the thruster 6 based on signals detected from, e.g., the accelerator lever 8, the steering wheel 9, and the joystick lever 10. The ship handling control device 15 may be configured to be capable of performing so-called automatic navigation that enables automatic handling of the ship along a route calculated from the current position and the preset destination based on the information from the GPS device 13.

In the ship handling control device 15, various programs and data for controlling the engines 2, the switching clutches 3, and the thruster 6 are stored. The ship handling control device 15 may have a configuration in which a CPU, a ROM, a RAM, an HDD, and/or the like are connected to each other via a bus, or may have a configuration including a single-chip LSI and/or the like.

The ship handling control device 15 is connected to the switching clutches 3 and the ECUs 16 of the engines 2, and can obtain information indicative of states of the switching clutches 3, information indicative of operation states of the engines 2, information indicative of rotation speeds N that the ECUs 16 obtain from various sensors, and various signals that the ECUs 16 obtain from various sensors.

The ship handling control device 15 can transmit, to the switching clutches 3, signals for changing (switching) clutch states.

The ship handling control device 15 can transmit, to the ECUs 16, signals for controlling the fuel adjustment valves of the fuel supply pumps, the fuel injection valves, and other various devices of the engines 2.

The ship handling control device 15 is connected to the accelerator lever 8 and the joystick lever 10, so that the ship handling control device 15 can obtain signals from the acceleration lever 8 and the joystick lever 10.

The ship handling control device 15 is connected to the GPS device 13 and the heading sensor 14, so that the ship handling control device 15 can obtain absolute coordinates and an absolute orientation of the ship 100.

The ship handling control device 15 is connected to the monitor 12, so that the current position of the ship 100 and/or the ship handling state achieved with the joystick lever 10 can be displayed.

The ship handling control device 15 is connected to a warning device 19 that is a notification means. If a voltage for driving the thruster 6 is lower than a predetermined threshold or if a temperature of the motor 6*b* included in the thruster 6 is higher than a predetermined threshold, the warning device 19 can notify an operator of it.

The ship handling control device 15 is connected to a mode changing switch 20. The mode changing switch 20 can perform switchover between a normal mode in which the engines 2 and the thruster 6 are driven according to an input signal from the joystick lever 10 and a thruster single-driven mode in which the thruster 6 is driven alone according to an input signal from the joystick lever 10.

Next, the following will describe drive control for the ship 100 that is performed by the ship handling control device 15 according to an operation with the joystick lever 10.

The ship handling control device 15 has, as a drive control mode, a normal mode in which driving of the forward-backward propellers 4 and the thruster 6 is controlled according to an input signal from the joystick lever 10 and a thruster single-driven mode in which driving of only the thruster 6 is controlled according to an input signal from the joystick lever 10. The ship handling control device 15 is connected to a mode changing switch 20 with which switchover between the normal mode and the thruster single-driven mode is performed. The ship handling control device 15 can recognize on/off switching of the mode changing switch 20. The mode changing switch 20 is configured such that the thruster single-driven mode is selected when the mode changing switch 20 is turned on and the normal mode is selected when the mode changing switch 20 is turned off.

The mode changing switch 20 is constituted by a tactile switch 20*a* that is a push switch and a display that is made of a light-emitting diode (LED) 20*b* disposed in an edge of the tactile switch 20*a*. When the tactile switch 20*a* is pressed, the LED 20*b* is turned on and the mode changing switch 20 is turned on. When the tactile switch 20*a* is pressed again, the LED 20*b* is turned off and the mode changing switch is turned off. The LED 20*b* is disposed in the edge of the tactile switch 20*a*. However, the present invention is not limited to such a configuration. Alternatively, for example, the LED 20*b* may be disposed near the tactile switch 20*a* or near the monitor 12. The mode changing switch 20 may be an on-off switch.

The tactile switch 20*a*, which is included in the mode changing switch 20, is disposed near the joystick lever 10. However, the present invention is not limited to such a configuration. The tactile switch 20*a* may alternatively be a switch disposed on a seat of the joystick lever 10. Further alternatively, the tactile switch 20*a* may be another one displayed on the monitor 12 of touch panel type, for example.

The following will describe drive control for the ship 100 that is performed according to an operation with the joystick lever 10 in the normal mode.

During the normal mode of the ship handling control device 15, when the joystick lever 10 is operated so that the joystick lever 10 is inclined in a desired direction, the joystick lever 10 generates signals for the forward-backward propellers 4 on both sides and the thruster 6 to cause the ship 100 to move in a direction corresponding to the operation with a thrust corresponding to the operation amount. When the joystick lever 10 is operated so that the joystick lever 10 turns about the lever axis, the joystick lever 10 generates signals for the forward-backward propellers 4 on both sides and the thruster 6 to cause the ship 100 to turn in a desired direction with a thrust corresponding to the operation amount.

Figure 5A:
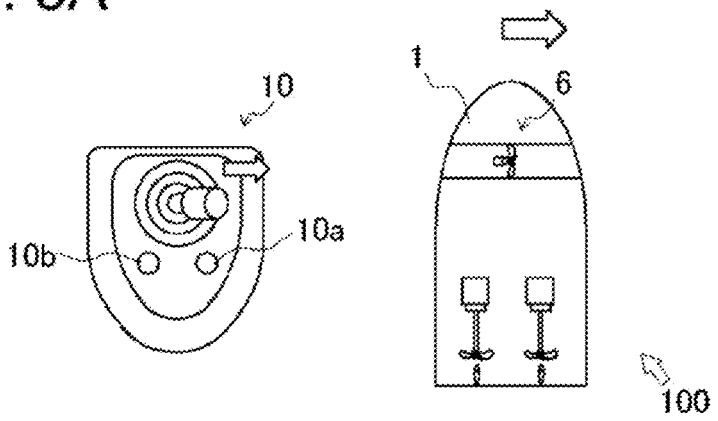
FIG. 5A is a view illustrating a direction in which the thruster is driven when the joystick lever is inclined to the right in a thruster single-driven mode.
Figure 5B:
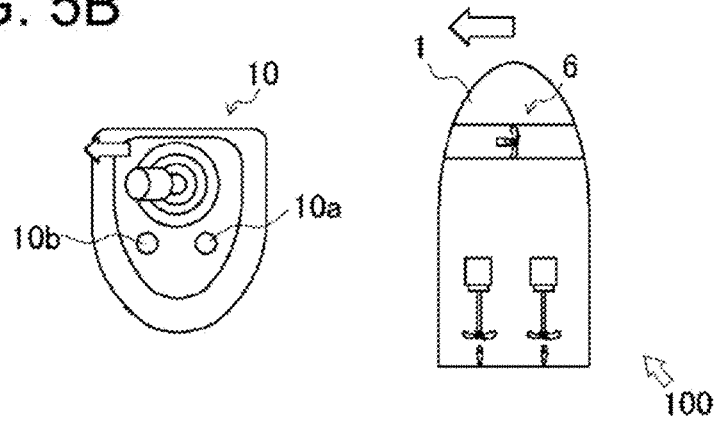
FIG. 5B is a view illustrating a direction in which the thruster is driven when the joystick lever is inclined to the left in the thruster single-driven mode.
Figure 5C:
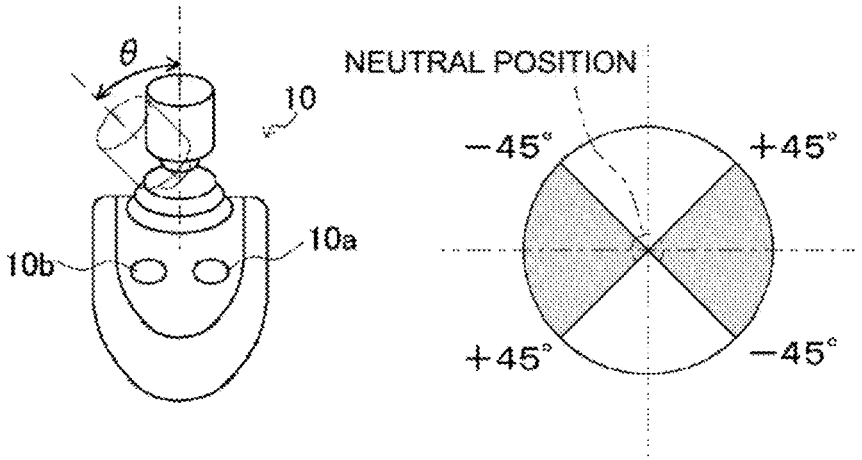
FIG. 5C is a view illustrating an operation amount of the joystick lever and a thruster driven zone of the joystick lever.

With reference to FIG. 5A to FIG. 5C, the following will describe drive control for the ship 100 that is performed according to an operation with the joystick lever 10 in the thruster single-driven mode.

During the thruster single-driven mode, when the joystick lever 10 is operated so that the joystick lever 10 is inclined in a thruster driven direction, a thrust of a desired magnitude is generated toward the left or the right of the ship 100. The thruster driven direction refers to, among desired directions of the joystick lever 10, a direction in which the thruster 6 is driven alone. In the present embodiment, the thruster driven direction is the left-and-right direction. Specifically, when the joystick lever 10 is inclined to the right, a thrust is generated toward the right of the ship 100 (see FIG. 5A). When the joystick lever 10 is inclined to the left, a thrust is generated toward the left of the ship 100 (see FIG. 5B).

For the thruster driven direction, a thruster driven zone, which corresponds to a predetermined angle range relative to the left-and-right direction of the joystick lever 10, is set so that the thruster 6 can be driven even when the joystick lever 10 is operated to a position deviated from a right lateral direction (left-and-right direction) within a predetermined range. The thruster driven zone is set so that it corresponds to a predetermined angle range relative to a line extending in the left-and-right direction from a neutral position of the joystick lever 10 in a plan view of the joystick lever 10. For example, in the present embodiment, the thruster driven zone is set to be ±45 degrees relative to the line extending in the left-and-right direction (see the shaded sections in FIG. 5C).

With the thruster driven zone that is set as described above, during the thruster single-driven mode, it is possible to easily drive the thruster 6 alone even by an operation input made with the joystick lever 10 in a direction that is not the right lateral direction. Consequently, the controllability of the ship 100 can be improved.

With reference to FIG. 5C, the following will describe a relation between an operation amount of the joystick lever 10 and a thrust of the thruster 6.

The operation amount of the joystick lever 10 refers to an inclination angle θ at which the joystick lever 10 is inclined from the neutral position. During the thruster single-driven mode, the ship handling control device 15 controls driving of the motor 6*b* in the thruster 6 based on the operation amount of the joystick lever 10, that is, the inclination angle θ, to generate a thrust of a desired magnitude. The operation amount of the joystick lever 10 is substantially proportional to a period of time taken for the motor 6*b* to start driving. Specifically, when the operation amount of the joystick lever 10 is small, i.e., when the inclination angle is small, the period of time taken for the motor 6*b* to start driving is adjusted to shorten a period in which the motor 6*b* is driven, thereby generating a small thrust. Meanwhile, when the operation amount of the joystick lever 10 is large, i.e., when the inclination angle is large, the period of time taken for the motor 6*b* to start driving is adjusted to increase a period in which the motor 6*b* is driven, thereby generating a large thrust.

In the above-described manner, it is possible to adjust a thrust generated in the left-and-right direction of the ship 100, based on the operation amount of the joystick lever 10. Accordingly, the ship 100 can cruise with fine adjustment. Consequently, the controllability of the ship 100 can be improved. For example, when the ship 100 is to leave from a mooring such as the coast, adjustment as below is possible. That is, while the ship 100 is close to the coast, the operation amount of the joystick lever 10 may be reduced so that the ship 100 can move away from the coast safely. Meanwhile, while the ship 100 is moving away from the coast, the operation amount of the joystick lever 10 may be increased so that the ship 100 can cruise at a higher speed.

In addition, when the ship 100 is to leave from or arrive at the coast, the bow of the ship 100 might be deviated from a desired position due to an effect given by, e.g., strong wind and/or waves during a work, such as a mooring work, that is necessary to be performed at a position close to the coast. In such a case, the orientation of the bow of the ship can be easily corrected with the joystick lever 10 that the operator is accustomed to use. Consequently, the controllability of the ship 100 can be improved.

As described above, the ship handling control device 15 enables to drive the thruster 6 alone according to an operation with the joystick lever 10, which is used to perform a handling operation of the ship 100. This configuration does not need an additional component such as a thruster controller. Consequently, the space can be saved. In addition, the ship handling tool included in this configuration is only the joystick lever 10. This can improve the controllability of the ship 100.

The motor 6*b* in the thruster 6 is configured to be rotatable at a desired rotation speed. Consequently, it is possible to directly adjust the number of revolution of the motor 6*b* based on the inclination angle θ of the joystick lever 10.

Figure 6:
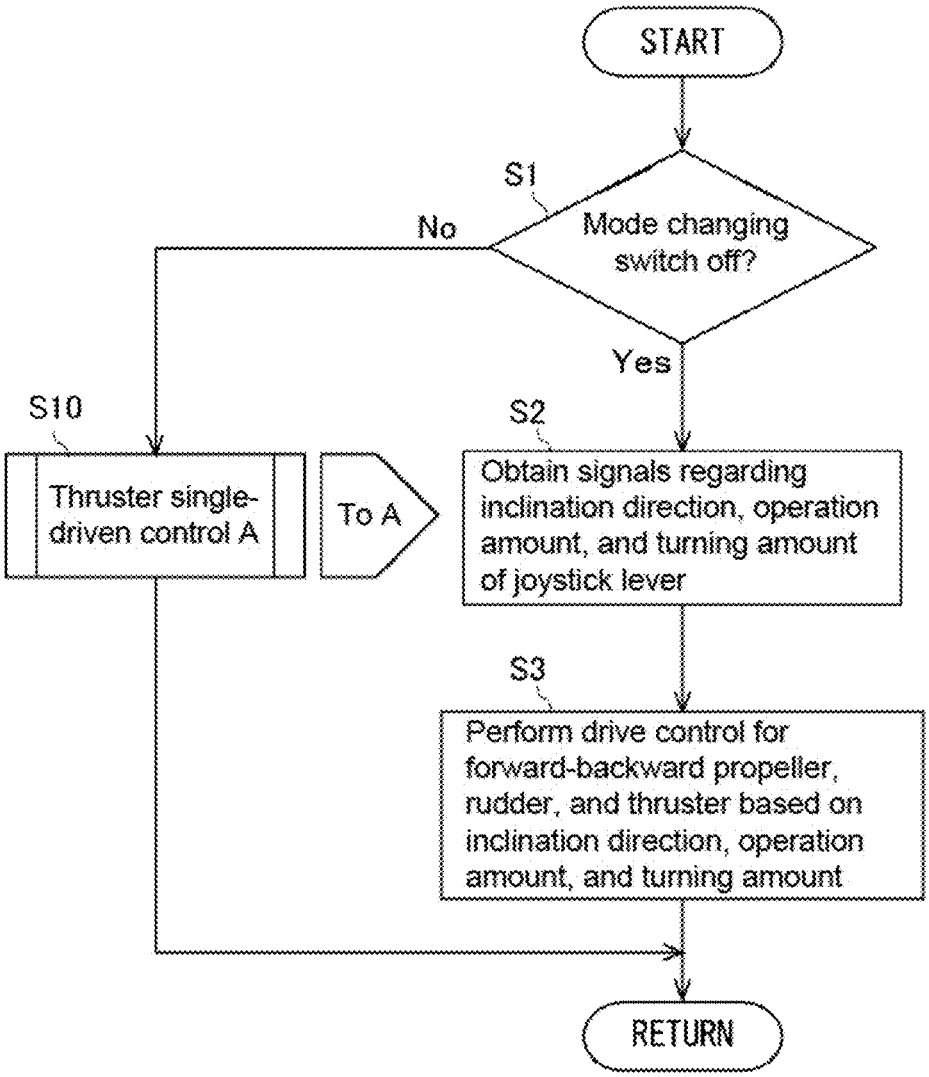
FIG. 6 is a flowchart of a control mode of drive control for the ship that is performed according to an operation with the joystick lever.

With reference to FIG. 6, the following will describe details of the drive control performed by the ship handling control device 15 in the normal mode.

In step S1, the ship handling control device 15 determines whether or not the mode changing switch 20 is off. If the mode changing switch 20 is determined to be off (normal mode), the process advances to step S2. If the mode changing switch 20 is determined not to be off, that is, if the mode changing switch 20 is determined to be on (thruster single-driven mode), the process advances to step S10.

In step S2, the ship handling control device 15 obtains signals for an inclination direction, an operation amount, and a turning amount of the joystick lever 10. Then, the process advances to step S3.

In step S3, drive control for the forward-backward propellers 4, switching states of the switching clutches 3, the rudders 5, and the thruster 6 is performed based on the inclination direction, the operation amount, and the turning amount of the joystick lever 10. Specifically, in order to perform turning control, the ship handling control device 15 controls thrusts of the forward-backward propellers 4, switching states of the switching clutches 3, the rudders 5, and a thrust and a rotation direction of the thruster 6 in the ship 100, based on a target turning amount calculated. Meanwhile, in order to perform moving control, the ship handling control device 15 controls thrusts of the forward-backward propellers 4, switching states of the switching clutches 3, the rudders 5, and a thrust and a rotation direction of the thruster 6 in the ship 100, based on a target moving amount and a target moving direction calculated.

Figure 7:
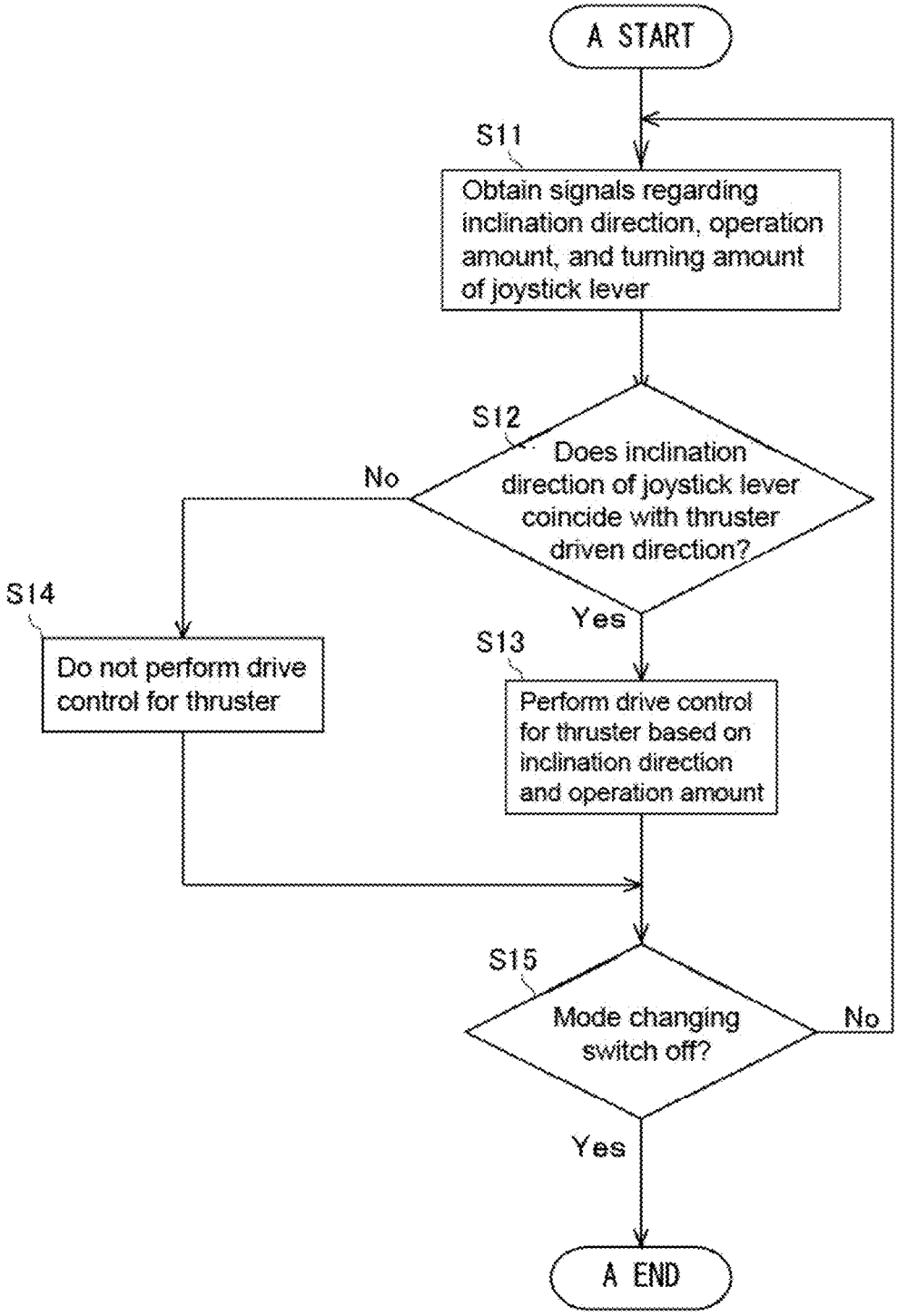
FIG. 7 is a flowchart of a control mode of drive control for the ship that is performed according to an operation with the joystick lever in the thruster single-driven mode.

With reference to FIGS. 6 and 7, the following will describe details of drive control performed by the ship handling control device 15 in the thruster single-driven mode.

In step S1, if the mode changing switch 20 is determined not to be off, that is, if the mode changing switch 20 is determined to be on (thruster single-driven mode), the process advances to step S10. When the thruster single-driven control is started in step S10, the process advances to step S11. When step S10 is ended, the process returns to step S1.

In step S11, the ship handling control device 15 obtains signals regarding an inclination direction, an operation amount, and a turning amount of the joystick lever 10. Then, the process advances to step S12.

In step S12, the ship handling control device 15 determines whether or not the inclination direction of the joystick lever 10 coincides with the thruster driven direction. If the inclination direction of the joystick lever 10 is determined to coincide with the thruster driven direction, the process advances to step S13. If the inclination direction of the joystick lever 10 is determined not to coincide with the thruster driven direction, the process advances to step S14.

In step S13, a rotation direction and a thrust of the thruster 6 are controlled based on the inclination direction and the operation amount of the joystick lever 10. Then, the process advances to step S15.

In step S14, the thruster 6 is not driven, and the process advances to step S15.

In step S15, it is determined whether or not the mode changing switch 20 is off. If the mode changing switch 20 is determined to be off, the thruster single-driven mode is ended and the process returns to the start point of the drive control (see FIG. 6). If the mode changing switch 20 is determined not to be off, that is, if the mode changing switch 20 is determined to be on, the process returns to the operation start point of the thruster single-driven mode.

In step S14, drive control for the forward-backward propellers 4, switching states of the switching clutches 3, the rudders 5, and the thruster 6 may be performed based on the inclination direction, the operation amount, and the turning amount of the joystick lever 10. That is, the ship handling control device 15 may be configured to perform, in step 14, drive control that is the same as the drive control in the normal mode. In order to drive the thruster 6 alone after the drive control that is same as the drive control in the normal mode has been performed, the joystick lever 10 may be returned to the neutral position and then be inclined in the thruster driven direction.

According to the above-described configuration, by operating the joystick lever 10 so that the joystick lever 10 is inclined in a direction that is not the thruster driven direction in the thruster single-driven mode, it is possible to cause the ship 100 to move in a direction corresponding to the direction in which the joystick lever 10 is inclined. Thus, for example, even in a dangerous situation that an obstacle or the like is about to collide against the ship body 1, it is possible to allow the ship 100 to avoid the obstacle or the like by quickly operating the joystick lever 10 so that the joystick lever 10 is inclined in a direction for avoidance. Consequently, even in the thruster driven mode, the ship can cruise safely, and the controllability of the ship 100 can be improved.

Figure 4:
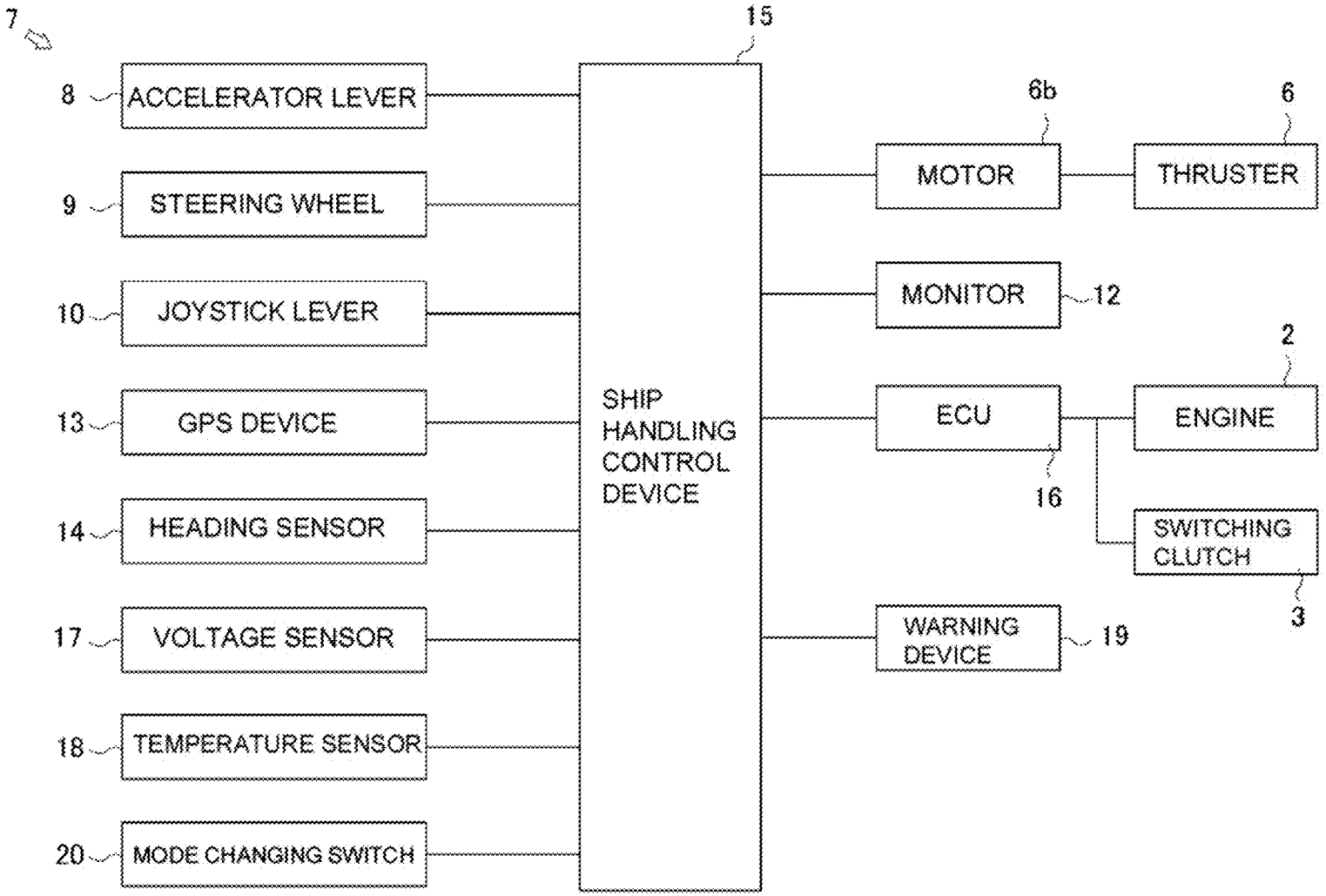
FIG. 4 is a block diagram illustrating a control system related to the ship handling device.

With reference to FIG. 4, the following will describe the voltage sensor 17.

The voltage sensor 17 detects a voltage for driving the motor 6*b* in the thruster 6. The ship handling control device 15 is configured such that, if a value detected by the voltage sensor 17 is lower than a predetermined value, the warning device 19 notifies the operator of it. The predetermined value is a value that is set to be higher by a desired value than a voltage value at which the motor 6*b* in the thruster 6 is stopped.

As described above, if a value detected by the voltage sensor 17 is lower than the predetermined value, the warning device 19 notifies the operator of it. Therefore, the operator can be notified of the voltage drop in the motor 6*b* before the motor 6*b* is stopped due to the voltage drop. When the operator is notified of the voltage drop by the warning device 19, the operator can prevent or reduce the voltage drop in the thruster 6, e.g., by charging a battery of the thruster 6 or by stopping or minimizing continuous use of the thruster 6. Consequently, it is possible to prevent or reduce the possibility of a dangerous situation in which the thruster 6 cannot be driven.

Note that a remaining level of a battery capacity of the motor 6*b* can be displayed on the monitor 12 based on a value detected by the voltage sensor 17. From the remaining level of the battery capacity displayed on the monitor 12, the operator can know, at any time, a period of time in which the thruster 6 can be driven. Consequently, the ship can cruise according to a schedule.

With reference to FIG. 4, the following will describe the temperature sensor 18.

The temperature sensor 18 detects a temperature of the motor 6*b* in the thruster 6. The ship handling control device 15 is configured such that, if a value detected by the temperature sensor 18 is higher than a predetermined value, the warning device 19 notifies the operator of it. The predetermined value is a value that is set to be lower by a desired value than a temperature value at which the motor 6*b* in the thruster 6 is stopped due to overheating.

As described above, if the value detected by the temperature sensor 18 is higher than the predetermined value, the warning device 19 notifies the operator of it. Therefore, it is possible to notify the operator of the temperature increase in the motor 6*b* before the motor 6*b* is stopped due to overheating. When the operator is notified of the temperature increase by the warning device 19, the operator can prevent or reduce the possibility of overheating of the thruster 6, e.g., by stopping or minimizing continuous use of the thruster 6. Consequently, it is possible to prevent or reduce the possibility of unintentional behavior of the ship 100 caused by overheating. In addition, as compared with a case where the motor 6*b* is overheated, it is possible to shorten a period of time required to start driving the thruster 6 again. Consequently, the controllability of the ship 100 can be improved.

INDUSTRIAL APPLICABILITY

The present invention is applicable to a ship handling device and ships including the ship handling device.

REFERENCE SIGNS LIST

1 ship body
2 engine
4 forward-backward propeller
5 rudder
6 thruster
7 ship handling device
10 joystick lever
12 monitor
15 ship handling control device
16 ECU
17 voltage sensor
18 temperature sensor
20 mode changing switch
100 ship

The invention claimed is:

1. A ship handling device comprising:

a joystick lever configurable into a plurality of positions relative to an axis of the joystick lever and configured to provide a first signal to a ship handling control device, the first signal indicating a position of the plurality of positions that the joystick lever is in;

the ship handling control device configured to control driving of a forward-backward propeller configured to generate a thrust in a front-and-rear direction of a ship body and a thruster configured to generate a thrust in a left-and-right direction of the ship body; and wherein:

the ship handling control device has a normal mode in which driving of the forward-backward propeller and the thruster is controlled according to the first signal from the joystick lever;

the ship handling control device has a thruster single-driven mode in which driving of only the thruster is controlled according to the first signal from the joystick lever, the ship handling control device configured to drive the thruster based on:

the joystick lever being within a first range of positions on a right side of a plane, the joystick lever configurable into a plurality of positions within the first range of positions and the plane positioned such that the axis of the joystick lever is contained within the plane; or the joystick lever being within a second range of positions on a left side of the plane, the joystick lever configurable into a plurality of positions within the second range of positions and the left side opposite the right side;

the ship handling control device is connected to a mode changing switch, the mode changing switch configured to send a second signal to the ship handling control device, the second signal indicating whether the ship handling control device is in the normal mode or the thruster single-driven mode; and in the thruster single-driven mode, the ship handling control device does not drive the thruster in a case where the joystick lever is inclined in a direction that is not a thruster driven direction.

2. The ship handling device according to claim 1, wherein, in the thruster single-driven mode, the ship handling control device is configured to adjust a rotation speed of the thruster based on an operation amount of the joystick lever, the operation amount of the joystick lever corresponding with an angle of the joystick lever with respect to the axis of the joystick lever.

3. A ship comprising the ship handling device according to claim 2.

4. A ship comprising the ship handling device according to claim 1.

* * * * *